US010370220B2

(12) United States Patent
Simcik et al.

(10) Patent No.: US 10,370,220 B2
(45) Date of Patent: Aug. 6, 2019

(54) FLEXIBLE DESTINATION DISPATCH PASSENGER SUPPORT SYSTEM

(71) Applicant: OTIS ELEVATOR COMPANY, Farmington, CT (US)

(72) Inventors: Paul A Simcik, Southington, CT (US); Eric C Peterson, East Longmeadow, MA (US); Bradley Armand Scoville, Farmington, CT (US); Ashley Marie Chapman, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 550 days.

(21) Appl. No.: 15/150,535

(22) Filed: May 10, 2016

(65) Prior Publication Data

US 2016/0347577 A1 Dec. 1, 2016

Related U.S. Application Data

(60) Provisional application No. 62/167,492, filed on May 28, 2015.

(51) Int. Cl.

| | |
|---|---|
| ***B66B 1/34*** | (2006.01) |
| ***B66B 1/24*** | (2006.01) |
| ***B66B 1/46*** | (2006.01) |
| *B66B 5/00* | (2006.01) |

(52) U.S. Cl.

CPC ..... *B66B 1/2408* (2013.01); *B66B 1/3407* (2013.01); *B66B 1/3415* (2013.01); *B66B 1/3476* (2013.01); *B66B 1/468* (2013.01); *B66B 5/0012* (2013.01); *B66B 2201/4615* (2013.01)

(58) Field of Classification Search

CPC ... B66B 1/2408; B66B 1/3407; B66B 1/3415; B66B 1/3476; B66B 1/468; B66B 5/0012; B66B 2201/4615

USPC ..... 187/247, 248, 380–389, 391, 395, 396, 187/392

See application file for complete search history.

(56) References Cited

U.S. PATENT DOCUMENTS

| | | | | |
|---|---|---|---|---|
| 4,662,479 A * | 5/1987 | Tsuji | B66B 1/2408 | 187/380 |
| 5,258,586 A | 11/1993 | Suzuki et al. | | |
| 5,298,697 A | 3/1994 | Suzuki et al. | | |
| 5,952,626 A | 9/1999 | Zaharia | | |
| 6,109,396 A * | 8/2000 | Sirag | B66B 1/468 | 187/381 |
| 6,209,685 B1 * | 4/2001 | Zaharia | B66B 1/468 | 187/381 |
| 6,397,976 B1 | 6/2002 | Hale et al. | | |
| 6,707,374 B1 * | 3/2004 | Zaharia | B66B 1/468 | 187/392 |

(Continued)

FOREIGN PATENT DOCUMENTS

| | | |
|---|---|---|
| CN | 101717026 A | 6/2010 |
| CN | 102502369 A | 6/2012 |

OTHER PUBLICATIONS

European Search for EP 16171802.8 dated Sep. 27, 2016.

*Primary Examiner* — Anthony J Salata

(74) *Attorney, Agent, or Firm* — Bachman & LaPointe, P.C.

(57) ABSTRACT

A method of passenger conveyance control includes receiving a destination request; tracking a passenger who entered the destination request while in a waiting area; and canceling the destination request in response to the passenger leaving the waiting area.

11 Claims, 7 Drawing Sheets

(56) References Cited

U.S. PATENT DOCUMENTS

| | | | | |
|---|---|---|---|---|
| 7,140,469 | B2 * | 11/2006 | Deplazes | B66B 1/3476 187/316 |
| 7,712,586 | B2 * | 5/2010 | Legez | B66B 1/20 187/387 |
| 8,020,672 | B2 * | 9/2011 | Lin | B66B 1/34 187/316 |
| 8,061,485 | B2 * | 11/2011 | Finschi | B66B 1/468 187/384 |
| 8,260,042 | B2 | 9/2012 | Peng et al. | |
| 8,584,811 | B2 | 11/2013 | Kuoppala et al. | |
| 9,045,314 | B2 * | 6/2015 | Finschi | B66B 1/467 |
| 9,079,751 | B2 * | 7/2015 | Sundholm | B66B 1/2458 |
| 9,238,568 | B2 * | 1/2016 | Nonami | B66B 1/468 |
| 9,365,393 | B2 * | 6/2016 | Salmikuukka | B66B 1/3461 |
| 9,988,238 | B2 * | 6/2018 | Simcik | B66B 1/468 |
| 2009/0208067 | A1 | 8/2009 | Peng et al. | |
| 2012/0305341 | A1 | 12/2012 | Kuoppala et al. | |
| 2013/0233653 | A1 | 9/2013 | Chen et al. | |
| 2013/0248300 | A1 | 9/2013 | Rusanen et al. | |
| 2014/0036086 | A1 | 2/2014 | Wagner et al. | |

* cited by examiner

ACTIVE PASSENGER LIST

| PASSENGER NUMBER | PASSENGER IDENTIFICATION CHARACTERISTIC | DESTINATION FLOOR |
|---|---|---|
| 1 |  | 32 |
| 2 |  | 17 |
| ⋮ | ⋮ | ⋮ |

FLEXIBLE DESTINATION DISPATCH PASSENGER SUPPORT SYSTEM

CROSS REFERENCE TO RELATED APPLICATION

This application claims the benefit of provisional application Ser. No. 62/167,492, filed May 28, 2015 entitled FLEXIBLE DESTINATION DISPATCH PASSENGER SUPPORT SYSTEM.

BACKGROUND

The present disclosure relates to a passenger conveyance and, more particularly, to demand requests.

Elevator performance can be derived from a number of factors. To an elevator passenger, an important factor can include travel time and wait time during debarking and embarking. For example, as time-based parameters are minimized, passenger satisfaction with the service of the elevator can improve. Satisfaction may be negatively affected should an elevator stop at a floor and no passengers debark or embark at that floor.

SUMMARY

A method of passenger conveyance control according to one disclosed non-limiting embodiment of the present disclosure can include receiving a destination request; tracking a passenger who entered the destination request while in a waiting area; and canceling the destination request in response to the passenger leaving the waiting area.

A further embodiment of the present disclosure may include, wherein receiving the destination request includes triggering a capture of passenger identification characteristic.

A further embodiment of the present disclosure may include, wherein the passenger identification characteristic is sufficient for tracking the passenger.

A further embodiment of the present disclosure may include, wherein the passenger identification characteristic is associated with the destination request.

A further embodiment of the present disclosure may include, wherein the passenger identification characteristic and the destination request is maintained as passenger identification data.

A further embodiment of the present disclosure may include, wherein the passenger identification data is cleared once the passenger debarks at the destination.

A further embodiment of the present disclosure may include, wherein the passenger identification data is maintained once the passenger debarks at a sky lobby prior to the destination.

A further embodiment of the present disclosure may include tracking the passenger to a sky lobby.

A further embodiment of the present disclosure may include, wherein the passenger identification data is cleared once the passenger debarks at the destination.

A further embodiment of the present disclosure may include, wherein the passenger identification characteristic is applied to a plurality of passengers determined to be traveling as a group.

A further embodiment of the present disclosure may include, wherein the waiting area is an elevator lobby.

A method of passenger conveyance control according to another disclosed non-limiting embodiment of the present disclosure can include receiving a destination request; capturing passenger identification characteristic of a passenger who entered the destination request; and associating the passenger identification characteristic with the associated destination request for each passenger on an active passenger list.

A further embodiment of the present disclosure may include canceling the destination request in response to the passenger leaving the waiting area.

A further embodiment of the present disclosure may include canceling the destination request in response to the passenger changing the destination request.

A further embodiment of the present disclosure may include, clearing the passenger from the active passenger list in response to that passenger debarking at the destination.

A further embodiment of the present disclosure may include tracking the passenger through a sky lobby.

A further embodiment of the present disclosure may include receiving the destination request from a kiosk remote from a waiting area.

A further embodiment of the present disclosure may include tracking the passenger from the kiosk to the waiting area remote from the kiosk.

A further embodiment of the present disclosure may include, wherein the passenger identification characteristic are sufficient for tracking the passenger.

A further embodiment of the present disclosure may include maintaining an elevator cab until the passenger embarks.

The foregoing features and elements may be combined in various combinations without exclusivity, unless expressly indicated otherwise. These features and elements as well as the operation thereof will become more apparent in light of the following description and the accompanying drawings. It should be appreciated, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
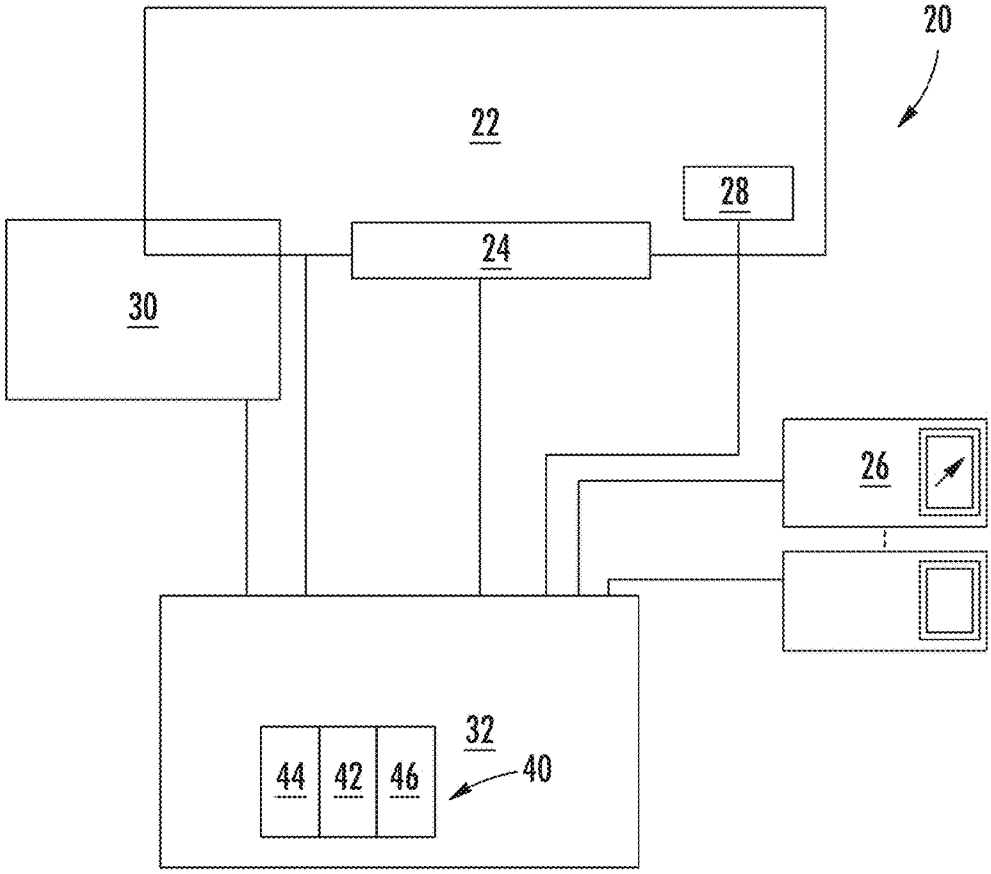
FIG. 1 is a schematic view of an elevator system according to one disclosed non-limiting embodiment.

FIG. 1 schematically illustrates a passenger conveyance system 20 such as an elevator system. The system 20 can include an elevator car 22 with an elevator door 24, a fixture 26 external to the elevator car 22, a car-operating panel (COP) 28 internal to the elevator car 22, a sensor system 30, and a control system 32. It should be appreciated that although an elevator system is disclosed and illustrated as an example herein, other passenger conveyance systems such as mass transit vehicles, access control passenger conveyance through various secure checkpoints, triggering video monitoring, hotel room access, and other detection, security, and identification, will also benefit herefrom. That is, passenger conveyance may be broadly construed as controls associated with passage of an individual or an identifiable group of individuals. It should be further appreciated that the fixture 26 may include a physically immobile device as well as portable devices, e.g. smartphones or "temporary kiosks." It should be still further appreciated that although particular systems are separately defined, each or any of the systems may be otherwise combined or separated via hardware and/or software.

Figure 2:
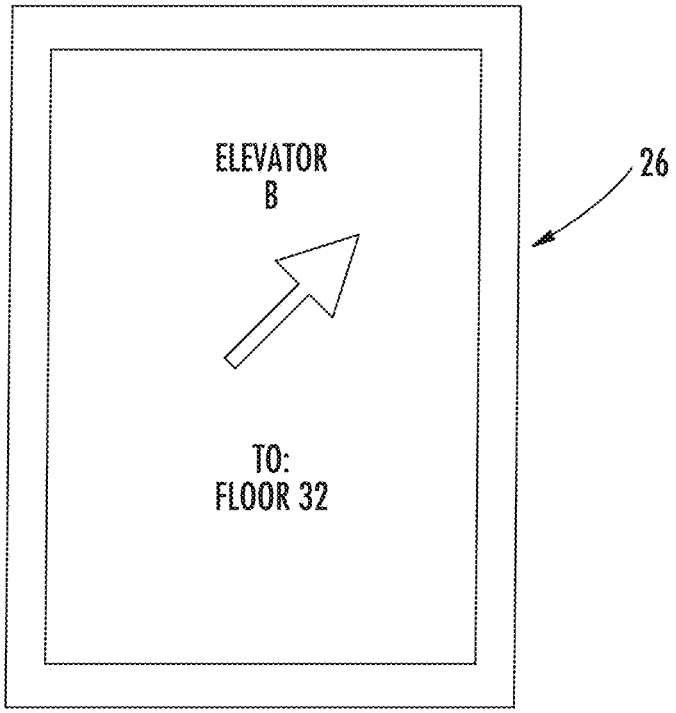
FIG. 2 is a schematic view of a fixture interface.

Various elevator systems can utilize a passenger-initiated input to request service. The fixture 26 may, for example, include a stand alone unit remote from the elevator car 22 or a control panel adjacent to the elevator car 22 while the COP 28 is located within the elevator car 22. Input from the fixture 26 may include a push button, e.g., up, down, or desired destination, to request elevator service. The passenger-initiated input is operable to notify the control system 32 a passenger that requires elevator service. In response, the control system 32 will efficiently dispatch an elevator car 22 to the appropriate floor, communicate a car assignment to the passenger, and provide directions to the passengers to the appropriate elevator in a multi-elevator system (FIG. 2). Optionally, once inside the elevator car 22, the passenger may push a button on the car-operating panel (COP) 28 to designate or change the desired destination.

The control system 32 can include a control module 40 with a processor 42, a memory 44, and an interface 46. The control module 40 can include a portion of a central control, a stand-alone unit, or other system such as a cloud-based system. The processor 42 can include any type of microprocessor having desired performance characteristic. The memory 44 may include any type of computer readable medium that stores the data and control processes disclosed herein. That is, the memory 44 is an example computer storage media that can have embodied thereon computer-useable instructions such as a process that, when executed, can perform a desired method. The interface 46 of the control module 40 can facilitate communication between the control module 40 and other systems which are a part of this embodiment, or other systems external to the elevator system, e.g. building management systems.

Figure 3:
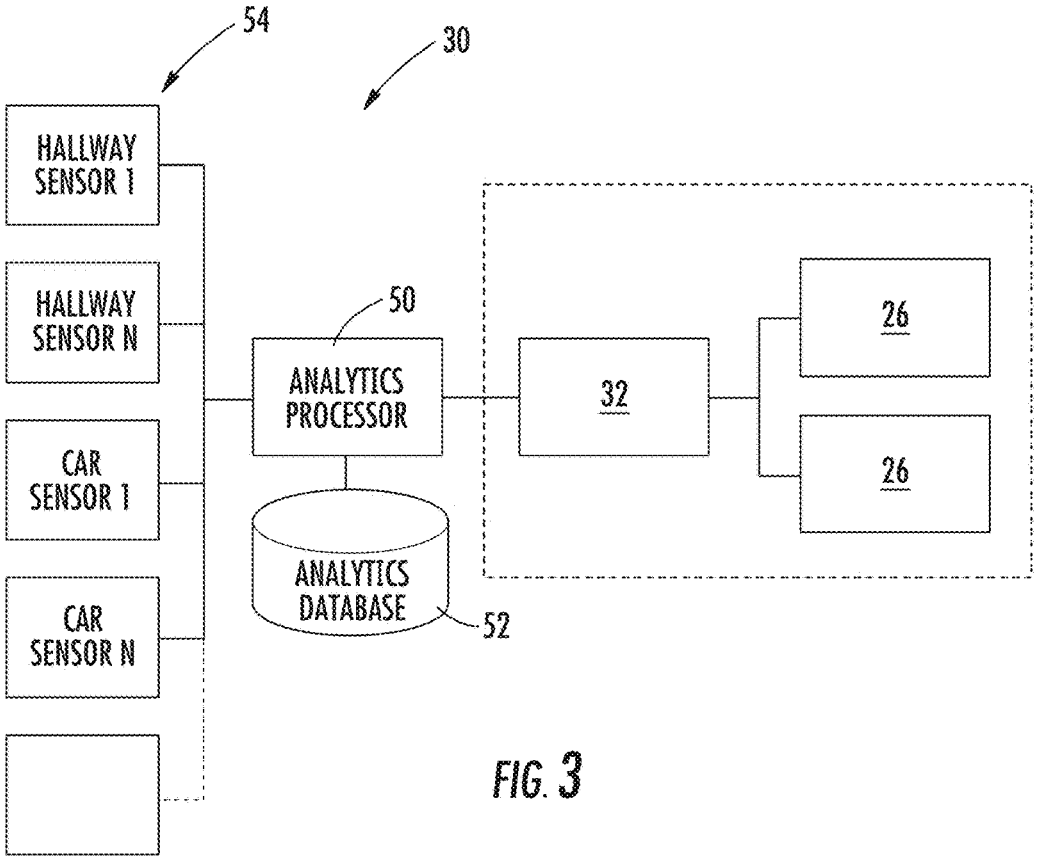
FIG. 3 is a block diagram of a sensor system for the elevator system.

With reference to FIG. 3, the sensor system 30 includes, an analytics processor 50, an optional analytics database 52, and a multiple of sensors 54. In one example, the sensor system 30, through the analytics processor 50, is operable to track the presence and movement of each passenger from the fixture 26 to, and within, a waiting area H (FIG. 4).

The plurality of sensors 54 facilitate overlapping coverage of the waiting area W. It should be appreciated that the term "sensor," is used throughout this disclosure for any sensor, or combination thereof. Such a sensor can be operable in the optical, electromagnetic or acoustic spectrum, or may aggregate multiple distinct sensor inputs into a single contact, e.g. to improve sensor performance.

Various depth sensing sensor technologies and devices include, but are not limited to, a structured light measurement, phase shift measurement, time of flight (TOF) measurement, stereo triangulation device, sheet of light triangulation device, light field cameras, coded aperture cameras, computational imaging techniques, simultaneous localization and mapping (SLAM), imaging radar, imaging sonar, scanning LIDAR, flash LIDAR, Passive Infrared (PIR) sensor, and small Focal Plane Array (FPA), or a combination thereof. Different technologies can include active (transmitting and receiving a signal) or passive (only receiving a signal) and may operate in a band of the electromagnetic or acoustic spectrum such as visual, infrared, etc. The use of depth sensing can have specific advantages over 2D imaging. The use of infrared sensing can have specific benefits over visible spectrum imaging such that alternatively, or additionally, the sensor can be an infrared sensor with one or more pixels of spatial resolution, e.g., a Passive Infrared (PR) sensor or small IR Focal Plane Array (FPA). Alternatively, or in addition, various fusions of the sensor data such as optical and depth sensing, or optical and RFID card detection may further be utilized.

Figure 4:
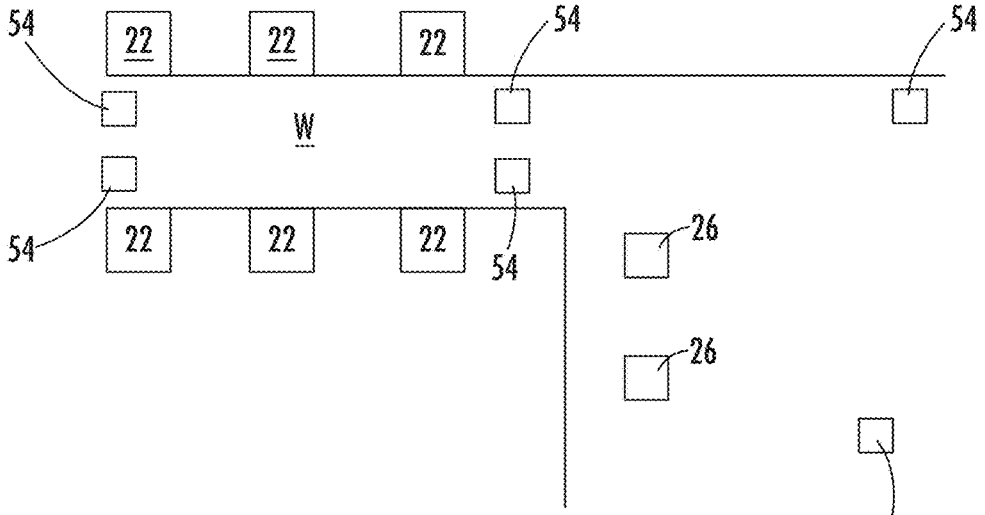
FIG. 4 is a schematic view for a waiting area for an elevator system.

In embodiments, one or more sensors 54 can be arranged with a field of view (FOV) or other spatially or symbolically bounded region of sensitivity toward the elevator cars 22 and the waiting area W, and one or more sensors 54 can be arranged with a FOV toward each fixture 26 (FIG. 4). The sensor system 30 may thereby provide a continuous view from the fixture 26 to the waiting area W. The plurality of sensors 54 may also be directed toward the waiting area W and the fixture 26 to provide detection from multiple directions to facilitate discrimination between and tracking of each passenger among a plurality of passengers.

Notably, there can be qualitative and quantitative differences between 2D imaging sensors, e.g., conventional security cameras, and 1D, 2D, or 3D depth sensing sensors to the extent that the depth-sensing provides numerous advantages. In 2D imaging, the reflected color (mixture of wavelengths) from the first object in each radial direction from the imager is captured. The 2D image, then, can include the combined spectrum of the source illumination and the spectral reflectivity of objects in the scene. A 2D image can be viewed by a person or image-recognition system and interpreted to not only discriminate between targets, but to personally identify individuals. In 1D, 2D, or 3D depth-sensing sensors, there is no color (spectral) information; rather, the distance (depth, range) to the first reflective object in a radial direction (1D) or directions (2D, 3D) from the sensor is captured. 1D, 2D, and 3D depth sensing technologies may have inherent maximum detectable range limits and can be of relatively lower spatial resolution than typical 2D imaging sensors. The use of 1D, 2D, or 3D depth sensing can advantageously provide improved operations compared to conventional 2D imaging in their relative immunity to ambient lighting problems, better separation of occluding objects, and better privacy protection. The use of infrared sensing can have specific benefits over visible spectrum imaging. For example, a 2D image may not be able to be converted into a depth map nor may a depth map have the ability to be converted into a 2D image (e.g., an artificial assignment of colors or grayscale to various depths may allow a person to crudely interpret a depth map somewhat akin to how a person sees a 2D image, it is not an image in the conventional sense, and is severely lacking in fine details required for specific identification of individuals.). This inability to convert a depth map into an image might seem a deficiency, but it can be advantageous in certain analytics applications disclosed herein.

The sensor 54 can be, in one example, an—line-scan LIDAR in which the field-of-view (FOV) can be, for example, about 180 degrees, which can horizontally cover the entire area of a lobby or other passenger area adjacent to the elevator doors 24. The output of the LIDAR may, for example, be a 2D horizontal scan of the surrounding environment at a height where the sensor 54 is installed. For an active sensor, each data point in the scan represents the reflection of a physical object point in the FOV, from which range and horizontal angle to that object point can be obtained. The scanning rate of LIDAR can be, as a specific but non-limiting example, 50 ms per scan, which can facilitate a reliable track of a passenger. That is, before application of analytic processes via the processing module 66, the LIDAR scan data can be converted to an occupancy grid representation. Each grid represents a small region, e.g., 5 cm×5 cm. The status of the grid can be indicated digitally, e.g., 1 or 0, to indicate whether each grid square is occupied. Thus, each data scan can be converted to a binary map and these maps then used to learn a background model of the lobby, e.g. by using processes designed or modified for depth data such as a Gaussian Mixture Model (GMM) process, principal component analysis (PCA) process, a codebook process, or a combination including at least one of the foregoing.

The analytics processor 50 may utilize various 3D detection and tracking processes such as background subtraction, frame differencing, and/or spurious data rejection that can make the system more resistant to spurious data (noise). Such spurious data can be inherent to depth sensing in general and may vary with the particular technology employed. For active techniques, where a particular signal is emitted and subsequently detected to determine depth (e.g., structured light, time of flight, LIDAR, and the like) highly reflective surfaces may produce spurious depth data, e.g., not the depth of the reflective surface itself, but of a diffuse reflective surface at a depth that is the depth to the reflective surface plus the depth from the reflective surface to some diffusely reflective surface. Highly diffuse surfaces may not reflect a sufficient amount of the transmitted signal to determine depth that may result in spurious gaps in the depth map. Even further, variations in ambient lighting, interference with other active depth sensors or inaccuracies in the signal processing may result in spurious data.

Sensor fusion may also advantageously utilize differences between 2D imaging sensors, e.g., imagery, and 1D, 2D, or 3D depth sensing sensors, and/or other means of spatial discrimination such as RFID cards, MAC addresses of wireless networked products, or RF beacons, to facilitate accurate tracking of each passenger. In 2D imaging, the reflected color (mixture of wavelengths) from the first object in each radial direction from the imager is captured. The 2D image, then, can include the combined spectrum of the source illumination and the spectral reflectivity of objects in the scene. In 1D, 2D, or 3D depth-sensing sensors, there is no color (spectral) information; rather, the distance (depth, range) to the first reflective object in a radial direction (1D) or directions (2D, 3D) from the sensor is captured. Tracking of each passenger permits confirmation that the each passenger remains in the waiting area H and boards the proper elevator car 22.

The sensor system 30 is operable to obtain passenger identification data for each passenger that enters a destination in the fixture 26. The analytics processor 66 is operable to communicate the passenger identification data obtained by the sensor system 62 for storage in the analytics database 68. The analytics database 68 thus stores a list of active passengers with their associated passenger identification characteristic and destination request as passenger identification data. This database may be a separate physical and/or logical construct, or optionally may be intrinsic to the sensor system. The database may include real-time data as well as more persistent data such as time- or location-based access permissions for individual users.

Figure 5:
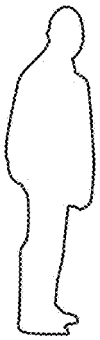
FIG. 5 is a representation of an active passenger list.
Figure 5:
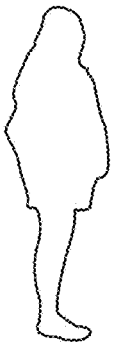
Figure 7:
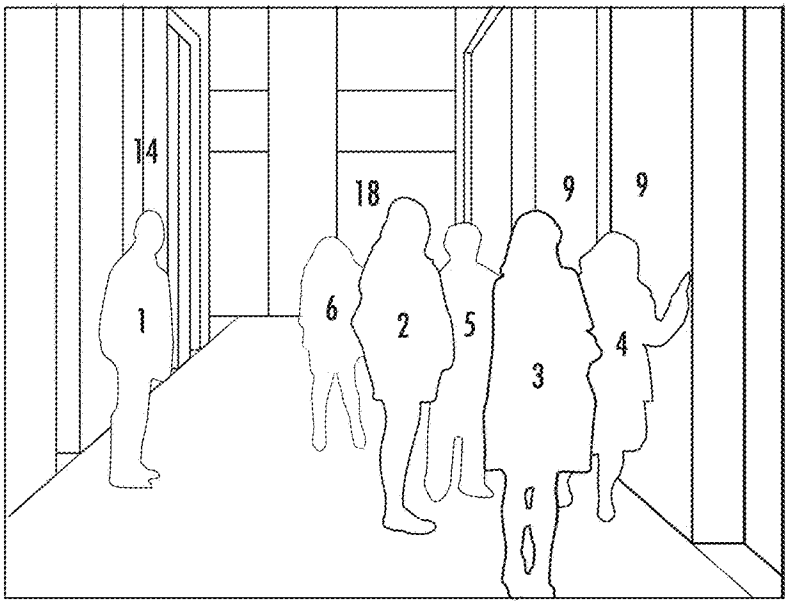
FIG. 7 is a view of the sensors in the waiting area in which passengers are tracked by destination.
Figure 6:
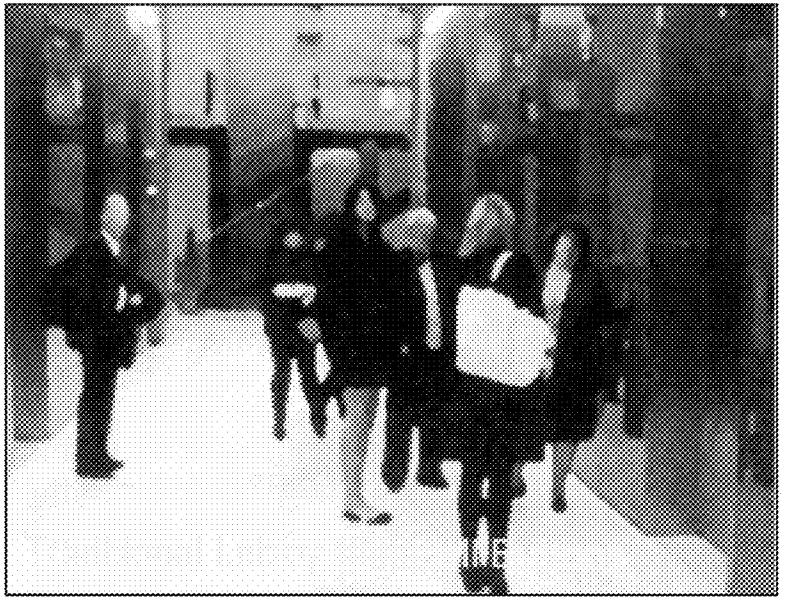
FIG. 6 is a view of a waiting area for an elevator system.

The passenger identification data may include, but not be limited to, a list of passenger identification characteristics and the corresponding passenger initiated destination request (FIG. 5). The passenger identification characteristics include data from the sensors 54 sufficient to differentiate and/or track each individual passenger (FIGS. 6 and 7). In one example, the passenger identification characteristic is outline-based, and may be based on optical segmentation, but may alternatively or additionally be non-optical clustering fused with other detection data such as that from electronically-detectable ID cards or devices. Passenger tracking may also be based on the binary foreground map and a method such as a Kalman/extended Kalman filter to track passengers and estimate the speed and moving direction thereof.

Based on detection, tracking, and counting, passenger data such as the presence of a passenger in the lobby, an estimated time of arrival (ETA), and a number of waiting passengers can be obtained. Such passenger data can then be used to, for example, improve lobby call registration and elevator dispatching. For example, the detection, tracking, and counting, facilitated by the depth-sensing device may facilitate registering a hall call for an approaching passenger, opening the car doors for an approaching passenger if a car is already at the floor; prepositioning a car based on an approaching passenger; and/or generating multiple hall calls based on the number of approaching passengers such as when multiple passenger essentially simultaneously leave a seminar. This information may also be used to confirm the number of waiting passengers matches the number of passengers recognized by the dispatcher, for example accounting for a group of 3 people traveling together only one of whom makes a destination entry.

Passenger tracking can utilize depth map data. Tracking may be regarded as a Bayesian Estimation problem, i.e., what is the probability of a particular system state given the prior system state, observations, and uncertainties. In such tracking, the system state may be the position of the tracked object, e.g, location and, possibly, velocity, acceleration, and other object characteristic, e.g., target features as disclosed elsewhere herein. The uncertainties are considered to be noise. Depending on what simplifying assumptions are made for mathematical tractability or efficiency, the Bayesian Estimation becomes the variants of Kalman Filtering (assumption of Gaussian additive noise) or the variants of Particle Filtering (assumption of non-Gaussian noise). In 2D and 3D object tracking, where there are many pixels/voxels on target, the system state often includes a target representation that includes discriminative information such as color descriptors (2D only), shape descriptors, surface reflectivities, etc. The possible target models are sensor and application specific and may be dynamically adapted by the system.

One disclosed non-limiting embodiment of depth data tracking for passenger tracking is based on Kalman Filtering and the system state includes five (5) variables: x, y, h, vx and vy, which represent target's real world x and y position, height, and velocities in the x and y directions. The tracking process includes two steps: prediction and update. A constant velocity model, or other types of model such as random walk or constant acceleration models, can be applied for prediction and, through the model, target states in a previous depth map can be transferred as initial conditions into the current depth map. A more complex model can be used if needed. In the update step, first all the targets in the current depth map are detected with an object detection process, i.e., depth based background subtraction and foreground segmentation, as disclosed elsewhere, then the detected targets are associated with predicted targets based on a global optimal assignment process, e.g. Munkres Assignment. The target's x, y, and h variables are used as features for the assignment, as they are effective to distinguish different targets for track association.

For the predicted target that has an associated detected target, the target system state can be updated according to the Kalman equation with the associated detected target as the observation. For a predicted target that has no associated detected target, the system state may stay the same, but the confidence of target will be reduced, e.g., for a target that is already going out of the field of view. A track will be removed if its confidence falls below a predetermined or selected value. For a detected target that has no associated predicted target, a new tracker will be initialized.

Other tracking approaches such as Particle Filtering may alternately or additionally applied which will be more robust in cases where a target abruptly changes its velocity. The Kalman approach requires relatively little computational resource and may therefore be more suitable for real-time application.

For depth map based tracking, various processes can be utilized. Particular motion detection functions, for example, using Bayesian Estimation, determine if a passenger is just shifting position, or is intentionally moving toward the doors 24 from within the car 22. This is particularly beneficial to specifically identify a passenger at the rear of a crowded car 22 who wishes to exit.

In 3D tracking, the common 2D descriptors such as color and 2D projected shape (e.g., 2D gradients) are not available. As such, a 3D descriptor, i.e., a surface reflectivity histogram, a Histogram of Spatial Oriented 3D Gradients (HoSG3D), etc. may be used. The HoSG3D is different than the 2D HoG3D descriptor because the 3rd dimension is spatial, while in HoG3D, the 3rd dimension is time. However, passenger shapes may be sufficiently similar that using only HoSG3D may not be sufficiently discriminative to unambiguously pass a track from one sensor to another. Notably, data fusion of both 2D descriptors and 3D descriptors facilitate effective generation of passenger identification characteristic more robustly than either descriptor used alone.

Figure 8:
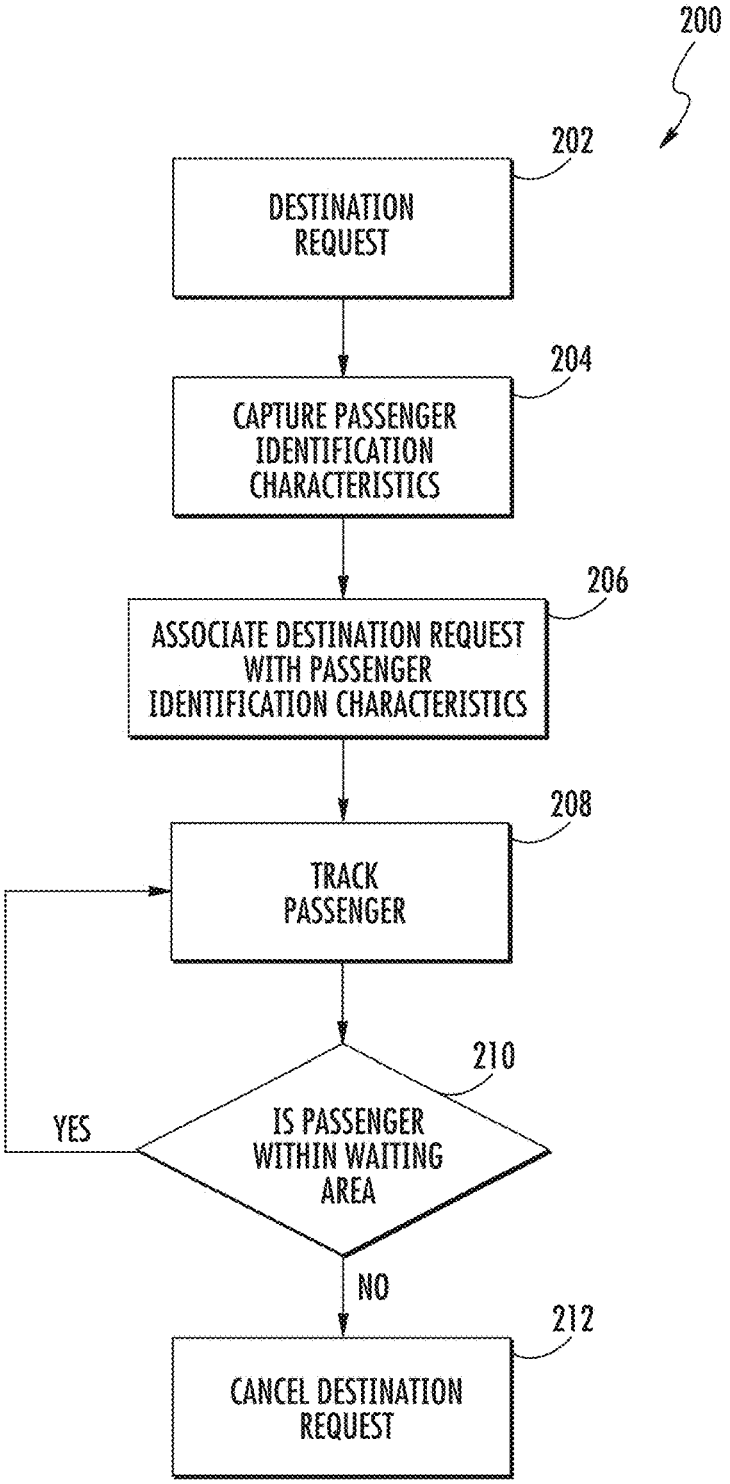
FIG. 8 is a block diagram for operation an elevator system according one disclosed non-limiting embodiment.

With reference to FIG. 8, a method 200 for operation of the system 20 is disclosed in terms of functional block diagrams. It should be appreciated that these functions may be enacted in either dedicated hardware circuitry or programmed software routines capable of execution in various microprocessor based electronics control embodiments.

Initially, a passenger enters a destination request at the fixture 26 (step 202). The destination request is utilized by the system 32 to efficiently dispatch the elevator car 22 to the appropriate floor. The fixture 26 may also provide directions to the passenger to the appropriate elevator car such as via a car identifier and a directional arrow thereto (FIG. 2).

The entry of the destination request may also be utilized to trigger capture of the passenger identification characteristic for each passenger that enters the destination in the fixture 26 by the sensor system 62 (step 204) such that each passenger has the passenger identification data associated with their particular destination request in the analytics database 68 (step 206). That is, the analytics database 68 stores the passenger identification characteristic and the associated destination request as the passenger identification data as an active passenger list (FIG. 5). The active passenger list can contain detailed information of each individual passenger, such as arrival time, origin lobby, destination lobby, etc. To generate the traffic list, each individual passenger is tracked from an initial point such as the fixture 26, to when the passenger leaves the elevator at their destination floor, as well as through an in-car track between the origin lobby and the destination lobby. Additionally, multiple discrete targets, based on proximity to each other and/or similarity in motion profiles (walking as a group), may be used to update destination dispatching algorithms with a more accurate estimate of the expected car loading is represented by a specific destination request. Also, the failure of a passenger/group of passengers to debark at their dispatcher-assigned destination floor may be used to trigger an alarm, reminding passengers that the current floor is their requested destination.

The analytics processor 66 thereafter communicates with the sensors 54 and the analytics database 52 to track each passenger to, and within, the waiting area W (step 208). The analytics processor 66 is constantly monitoring the data from the sensors 54 and operates to continually confirm that each passenger remains within the waiting area W, (step 210). Should the passenger leave the waiting area H, the analytics processor 66 will cancel the associated destination request (step 212) if there is no other passenger who has requested that floor. The analytics processor 66 also removes that specific passenger from the active passenger list. Such cancelation assures that the elevator does not stop at a floor and no passengers debark or embark at that floor.

Should the passenger(s) not leave the waiting area W and enter the correct elevator car 22, the system may generate a reinforcing alert, e.g. voice prompt "passengers for floor 10 should board elevator D." Upon further failure of the passenger(s) to leave the waiting area W, the analytics processor 66 will then clear the passenger(s) from the analytics database 68 once the passenger debarks at their destination. The analytics processor 66 maintains the passenger/passenger group identification data and thus tracks each passenger/passenger group and its destination floor. Upon arrival at each destination floor, the analytics processor 66 can further track whether all the passengers for that destination floor debark the elevator car 22. Such tracking may also then be utilized to maintain the elevator door 24 in an open position until all the passengers for that destination floor debark, or more quickly close the elevator door 24 upon confirmation that all the passengers for that destination floor debark.

Alternatively, should the destination be a second waiting area such as a sky lobby or other transfer type floor, the door open time for the next elevator can also be extended until the passenger embarks. Thereafter, the analytics processor 66 will clear the passenger from the analytics database 68 only once the passenger debarks at their destination subsequent to the second waiting area, i.e. once the elevator car 22 performs a complete cycle.

In another embodiment, should the passenger enter a new destination request at the fixture—COP 28, the analytics processor 66 will cancel the original destination request (step 212). Again, such cancelation assures that the elevator does not stop at a floor and no passengers debark or embark at that floor.

The system improves overall elevator service performance by eliminating unnecessary stops at floors when a passenger choose to not use the elevator assigned or changes their destination. The system also improves individual passenger service for forgetful, unobservant, hearing-impaired, mobility-impaired, or crowd-bound passengers. If a passenger uses a sky lobby to transfer to another elevator, the system is tracks the passenger that does not complete this journey and cancels upcoming elevator service.

The elements disclosed and depicted herein, including in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, dynamically loaded or updated modules, or any combination of these, and all such implementations may be within the scope of the present disclosure.

It should be appreciated that like reference numerals identify corresponding or similar elements throughout the several drawings. It should also be appreciated that although a particular component arrangement is disclosed in the illustrated embodiment, other arrangements will benefit herefrom.

Although the different non-limiting embodiments have specific illustrated components, the embodiments are not limited to those particular combinations. It is possible to use some of the components or features from any of the non-limiting embodiments in combination with features or components from any of the other non-limiting embodiments.

Although particular step sequences are shown, disclosed, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason the appended claims should be studied to determine true scope and content.

What is claimed is:

1. A method of passenger conveyance control, the method comprising:

receiving a destination request;

triggering a capture of passenger identification characteristic sufficient for tracking a passenger, wherein the passenger identification characteristic and the destination request is maintained as passenger identification data;

associating a passenger identification characteristic with the destination request;

tracking a passenger who entered the destination request while in a waiting area, wherein the passenger identification data is maintained once the passenger debarks at a sky lobby prior to the destination;

canceling the destination request in response to the passenger leaving the waiting area in the sky lobby; and clearing the passenger identification data once the passenger debarks at the destination.

2. The method as recited in claim 1, wherein the passenger identification data is cleared once the passenger debarks at the destination.

3. The method as recited in claim 1, further comprising tracking the passenger to a sky lobby.

4. The method as recited in claim 1, wherein the passenger identification characteristic is applied to a plurality of passengers determined to be traveling as a group.

5. The method as recited in claim 1, wherein the waiting area is an elevator lobby.

6. A method of passenger conveyance control, the method comprising:

receiving a destination request;

capturing passenger identification characteristic of a passenger who entered the destination request;

associating the passenger identification characteristic with the associated destination request for each passenger on an active passenger list;

tracking each passenger who entered the destination request through a second waiting area;

canceling the destination request for a passenger in response to the passenger leaving the second waiting area; and clearing the passenger from the active passenger list in response to the passenger who had left the second waiting area debarking at the destination.

7. The method as recited in claim 6, further comprising receiving the destination request from a kiosk remote from a waiting area.

8. The method as recited in claim 7, further comprising tracking the passenger from the kiosk to the waiting area remote from the kiosk.

9. The method as recited in claim 8, wherein the passenger identification characteristic are sufficient for tracking the passenger.

10. The method as recited in claim 9, further comprising maintaining an elevator cab until the passenger embarks.

11. The method as recited in claim 6, wherein the second waiting area is a sky lobby.

* * * * *